US006696788B2

(12) United States Patent
Lapatovich et al.

(10) Patent No.: US 6,696,788 B2
(45) Date of Patent: Feb. 24, 2004

(54) DOUBLE JACKETED HIGH INTENSITY DISCHARGE LAMP

(75) Inventors: Walter P. Lapatovich, Boxford, MA (US); Christopher Scott Nordahl, Beverly, MA (US)

(73) Assignee: Osram Sylvania Inc., Danvers, MA (US)

( * ) Notice: Subject to any disclaimer, the term of this patent is extended or adjusted under 35 U.S.C. 154(b) by 16 days.

(21) Appl. No.: 10/170,958

(22) Filed: Jun. 13, 2002

(65) Prior Publication Data

US 2003/0117074 A1 Jun. 26, 2003

Related U.S. Application Data

(60) Provisional application No. 60/342,348, filed on Dec. 21, 2001.

(51) Int. Cl.[7] ..... H01J 17/16

(52) U.S. Cl. ..... 313/634; 313/17; 313/637; 313/26; 313/36; 313/623; 315/248; 315/56

(58) Field of Search ..... 313/17, 25–27, 313/36, 47, 623, 634–638, 641, 643; 315/39, 39.51, 248, 56, 111.01

(56) References Cited

U.S. PATENT DOCUMENTS 4,189,661 A * 2/1980 Haugsjaa et al. ..... 315/39
4,710,679 A * 12/1987 Budinger et al. ..... 315/58
4,945,288 A * 7/1990 Morris et al. ..... 313/25
4,949,003 A * 8/1990 Cox et al. ..... 313/25
4,983,889 A * 1/1991 Roberts ..... 315/246
5,404,076 A * 4/1995 Dolan et al. ..... 313/572
5,424,609 A * 6/1995 Geven et al. ..... 313/623
5,757,130 A * 5/1998 Dolan et al. ..... 313/574
6,300,716 B1 * 10/2001 Honda ..... 315/51
6,316,875 B1 * 11/2001 Kirkpatrick et al. ..... 313/633

* cited by examiner

*Primary Examiner*—Haissa Philogene
(74) *Attorney, Agent, or Firm*—William E. Meyer

(57) ABSTRACT

An electric discharge lamp includes a light transmissive inner jacket that defines a sealed inner chamber, a first material in the inner chamber that emits light when activated, and a light transmissive outer jacket around the inner jacket. The outer jacket defines a sealed outer chamber between the inner and outer jackets that contains a second fill material. The second fill material, when activated by heat from the inner chamber when the lamp is operating, converts ultraviolet (UV) and deep blue light emitted from the inner chamber to visible light, thereby increasing an amount of visible light transmitted through the outer jacket compared to an amount of visible light transmitted through the inner jacket.

30 Claims, 6 Drawing Sheets

DOUBLE JACKETED HIGH INTENSITY DISCHARGE LAMP

The Applicants hereby claim the benefit of their provisional application, Ser. No. 60/342,348 filed Dec. 21, 2001 Dual Chambered High Intensity Discharge Lamp.

BACKGROUND OF THE INVENTION

The present invention is directed to an electric discharge lamp with an inner and an outer jacket and, more specifically, to a high intensity discharge (HID) lamp that has two generally concentric jackets.

Modern metal halide sealing technology and the advent of ceramic lamp envelopes have led to development of a new class of metal halide lamps, such as described in U.S. Pat. No. 5,424,609 and in J. Ill. Eng. Soc. P 139–145, Winter 1996 (Proc. of IESNA Annual Conference). These lamps contain metal halide fill chemistries and two electrodes, and rely on the application of a high voltage pulse between the electrodes to ignite the lamp. Normal current and voltage are then applied through the two electrodes. The gases within the vessel are excited into a plasma state by the passing of electric current. Typical chemical fills include scandium and rare earth halides with various other additives including thallium halide and calcium halides, in addition to a starting inert gas such as argon or xenon.

The arc tube, in which the plasma is contained, also called a burner, is often jacketed within another envelope, called the outer jacket, to protect it from the air. Many of the lamp parts, especially niobium electrical inleads, can oxidize rapidly at operating temperatures and cause the lamp to fail. These outer jackets are usually well removed from the burner and filled with an inert gas and a getter material, for example a zirconium-aluminum compound, to getter oxygen and hydrogen. While the outer jacket is in thermal contact with the burner, the contact is limited so the outer jacket can operate at substantially lower temperatures, for example about 200° C. compared to the burner at 900° C. One such double jacketed lamp is described in U.S. Pat. No. 4,949,003 and another is described in U.S. Pat. No. 6,316,875.

Lamps have been made with a vitreous silica envelope that contain chemistries other than metal salts, such as sulfur, tellurium and selenium as described in U.S. Pat. No. 5,404,076. These lamps are powered by microwaves and can be quite efficient, for example 130 lumens/$W_{rf}$, but have never successfully penetrated the market because of power supply inefficiencies and the generally large lumen output for 1 kW lamps (>130,000 lm). The difficulties in operating these lamps in an electroded manner, at wattages less than a kilowatt, is the rapid and violent attack on the electrodes by the chemical fill. For example, tungsten electrodes react in the presence of hot sulfur vapor to form tungsten sulfide, which vaporizes, and lamp operation ceases. Elaborate schemes for using these chemical fills with protected electrodes have been discussed in the literature, but have not materialized in the marketplace, for example U.S. Pat. No. 5,757,130 and U.S. Pat. No. 6,316,875.

There is great interest in improving the efficacy of high intensity discharge (HID) lamps for environmental reasons and for introduction of HID lamps into residential markets. Improving the HID lamp efficacy should translate into lower wattage lamps (less power) operating on low wattage (less expensive) electronic ballasts in homes, similar to compact fluorescent systems, while providing more visible light. In addition, for higher wattage HID lamps, should result in lower utility bills for cities and towns and industrial installations without sacrificing safety or illumination levels.

SUMMARY OF THE INVENTION

Accordingly, an object of the present invention is to provide a double jacketed HID lamp that has a greater visible light output than the conventional double jacketed HID lamp.

A further object of the present invention is to provide a electric discharge lamp that has a double jacketed bulb with a sealed inner chamber containing a first material that emits light when activated and a separately sealed outer chamber between the double jackets, where the outer chamber contains a second fill material that converts light outside the visible spectrum that has been emitted from the inner chamber to light in the visible spectrum, which is emitted from the outer chamber, to thereby increase an amount of visible light generated by the lamp.

A yet further object of the present invention is to provide such a lamp where the second fill material in the outer chamber is vaporizable by heat from the inner chamber during operation of the lamp.

Another object of the present invention is to provide such a lamp where the second fill material in the outer chamber converts ultraviolet and deep blue light from the inner chamber to light in the visible spectrum.

Yet another object of the present invention is to provide such a lamp where the second fill material is one of sulfur, selenium, and tellurium.

Still another object of the present invention is to provide a method of increasing an amount of visible light from a double jacketed lamp that includes the step of providing a material in the outer chamber that, when vaporized by heat from the inner chamber when the lamp is operating, converts ultraviolet (UV) light emitted from the inner chamber to a visible light, thereby increasing an amount of visible light transmitted through the outer jacket from an amount of visible light transmitted through the inner jacket.

DESCRIPTION OF PREFERRED EMBODIMENTS

Figure 1:
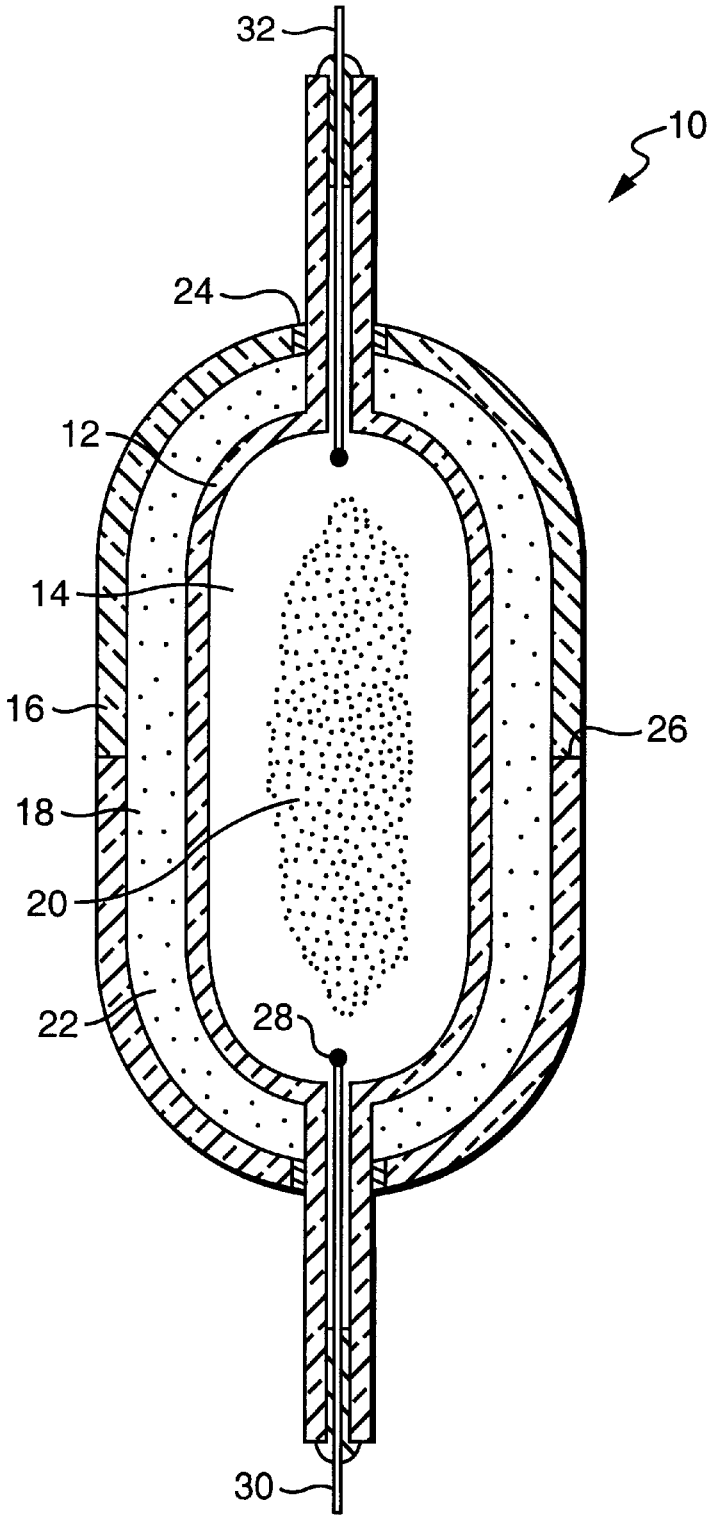
FIG. 1 is a schematic cross-sectional view of a preferred embodiment of a double jacketed lamp.

With reference now to FIG. 1, an embodiment of a double jacketed lamp includes a double jacketed bulb 10 with an inner light transmissive jacket 12 that defines a sealed inner chamber 14 and with an outer light transmissive jacket 16 around a light transmissive portion of inner jacket 12 that defines a separately sealed outer chamber 18 between inner jacket 12 and outer jacket 16. Outer jacket 16 is in thermally transmissive contact with inner jacket 12 so that heat generated in inner chamber 14 reaches outer chamber 18. Inner chamber 14 contains a first material 20 that is a vapor or is vaporizable and that emits light and heat when activated. Outer chamber 18 contains a second fill material 22 that, when activated by heat and radiation from inner chamber 14 when the lamp is operating, converts radiation, for example ultraviolet (UV) light and deep blue light emitted from inner chamber 14 to visible light. The first preference is to increase the amount of visible light transmitted through outer jacket 16 from an amount of visible light transmitted through inner jacket 12, but it is also possible to shift the overall color to a more preferred value.

During operation of lamp 10, heat generated in inner chamber 14 partially or completely vaporizes second fill material 22 in outer chamber 18. At the same time, some or all of spectrum emitted by the discharge in the inner chamber (first spectrum) passes through the inner envelope wall. The preferred second fill material 22 is chosen so that the vapor of second fill material 22 is largely transparent to the desirable part of the first spectrum, for example the visible light generated in inner chamber 14, thereby not substantially reducing the inherent visible light generated in inner chamber 14. The second fill material 22 is also chosen so that its vapor is opaque to, so as to absorb, the less preferred or chosen sacrificial wavelengths generated in the inner chamber 14, such as unwanted ultraviolet (UV) or deep blue light. The vapor in the outer chamber then re-radiates the absorbed radiation as light (second spectrum) in the more preferred part of the spectrum, such as the visible spectrum. The re-radiated visible light then supplements or increases the amount of light in the preferred part of the spectrum (e.g. visible) transmitted through outer jacket 16 from an amount of light in that part of the spectrum (e.g. visible) transmitted through just the inner jacket 12, or helps provide a better color rendition characteristic by improving a continuum of the total emitted light spectrum.

Figure 2:
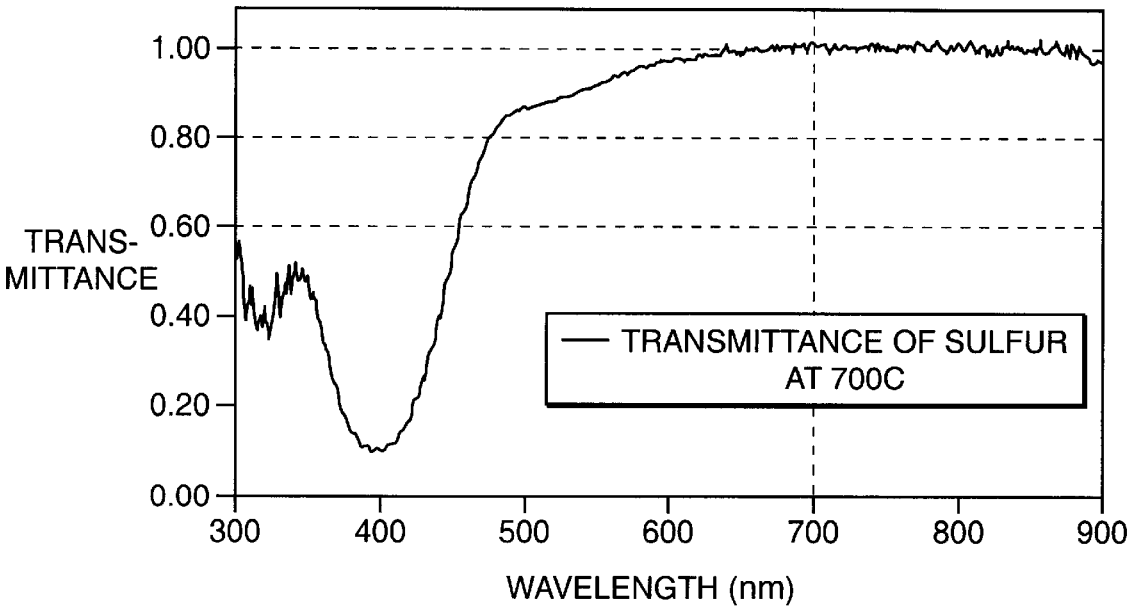
FIG. 2 is a graph of sulfur transmittance at 700° C. as a function of wavelength.

Second fill material 22 may include sulfur, selenium, tellurium or other components that have the absorption and re-radiation characteristics just noted. FIG. 2 shows the transmittance of sulfur as a function of wavelength at 700° C. (an approximate temperature in outer chamber 18 when inner chamber 14 has a wall temperature of above 850° C., as is typical in HID lamps). As is apparent, absorption (one minus the transmittance) is strong for wavelengths less than about 450 nanometers, which includes deep blue and ultraviolet light. Thus, ultraviolet light radiation and deep blue light are absorbed at temperatures reached during operation of the lamp while wavelengths longer than 450 nanometers pass unattenuated through the sulfur vapor.

Figure 3:
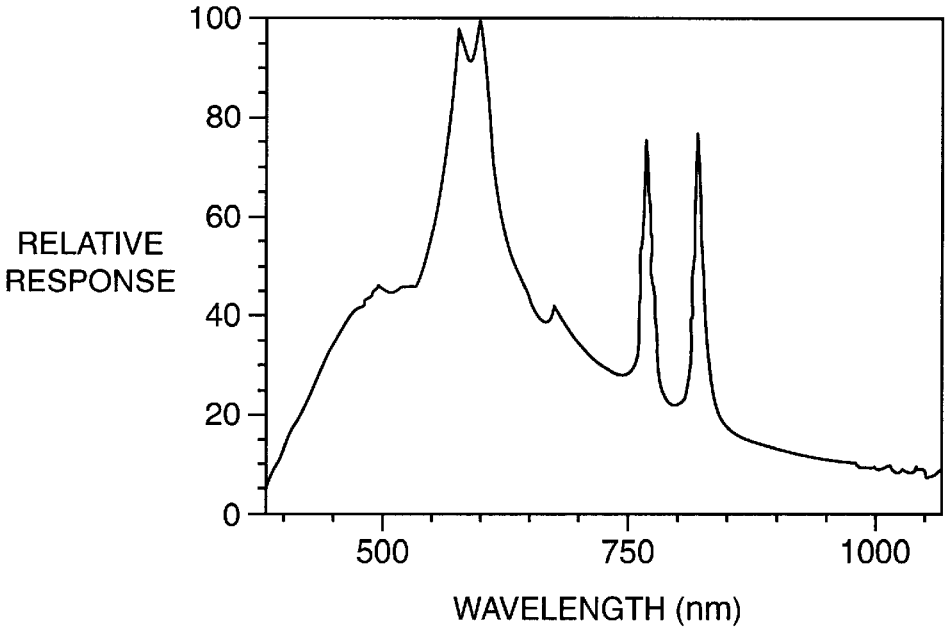
FIG. 3 is a graph of the relative spectral radiance of a sulfur and sodium iodide discharge lamp as a function of wavelength.

FIG. 3 shows the relative spectral radiance of a sulfur and sodium iodide discharge lamp as a function of wavelength. The output approximates a surface emitter. Most of the output occurs in the visible range. The peaks at 590, 770, and 820 nanometers are from the alkalis, while the underlying broad continuum is from the sulfur. FIG. 3 also shows that the sulfur vapor is largely transparent to visible radiation, as evidenced by the strong alkali emissions.

By way of example, in a lamp that operates at about 90 lumens per Watt, if the spectral power of the ultraviolet light and deep blue light were about three Watts, the sulfur vapor in the outer chamber would add about 270 lumens to the visible light emitted from the lamp.

Other outer chamber fill materials may also be suitable for second fill material 22, such as carbon disulfide, boron sulfide, phosphorus, mercury halides, and excimer mixes such as xenon with: HCl or other halogen donor such as $AlCl_3$; sodium or another alkali; or iodine vapor.

The vapor of the second fill material can be molecular in nature, for example, sulfur, tellurium, selenium, mercury (II) bromide, etc., or can be atomic such as indium, sodium, with or without a rare gas. In the case of atomic vapors or excimer systems, the presence of a rare gas at substantial density greatly enhances the radiation redistribution through the process of quasi-molecular formation between the atom and rare gas.

By way of further explanation of operation of a double jacketed lamp (and without being bound by theory), the absorption of the second fill material vapor in the outer chamber between the inner and outer jackets is approximately, $$A=1-e^{-n\sigma x}$$

where A is the absorptance, n is the number density of vapor species determined by the vapor pressure of the material in the space, σ is the absorption cross section for the ultraviolet light and deep blue region nominally for λ less than 450 nanometers, and x is the path length for absorption, or the distance between shells. If the absorbing re-radiating vapor is chosen carefully, most of the absorbed radiation is re-emitted principally at visible wavelengths. This process is called radiation redistribution. It is as if the vapor is made to fluoresce. The process is generally most efficient when the radiation is Stokes shifted, that is shifted from a higher energy, such as UV, to a lower energy, such as visible.

Returning now to FIG. 1, inner chamber 14 may be dosed with the first material 20 and sealed to be hermetic using conventional techniques available to one skilled in the art of lamp manufacturing. Upon excitation by electric current, the first material 20 is excited into a radiating state that produces visible light as well as less preferred or sacrificial wavelength light such as infrared, ultraviolet light or deep blue light. The first material 20 in the inner chamber 12 can be typical of HID lamps. It may be a sodium-scandium iodine mix where the sodium to scandium ratio is in the range of 40:1 to 0.5:1 and more preferably in the range of 12:1 to 1.5:1. The inner chamber 12 may contain mercury also and an inert starting gas such as neon, argon, krypton or xenon or mixtures thereof in amounts between 1.0 torr to 8000 torr, with the preferred range of 35 torr to 400 torr. The mercury content may range from 0 $mg/cm^3$ to 30 $mg/cm^3$ with the preferred value about 13 $mg/cm^3$. On the low end, the lamp is substantially mercury free.

Other suitable first materials 20 may be selected from metal iodides such as Dy, Tm, Ho iodides in combination with Ca, Zn iodides or alone. A suitable first material could be $DyI_3$:$HoI_3$:$TmI_3$:TlI:NaI:$CaI_2$ in the weight ratios of 12.6:12.6:12.6:10:12.5:39.7. If the lamp is to be mercury free, suitable selections would be to combine Dy, Tm and Ho with Ca iodides and use Zn iodide as the voltage enhancing additive, such as described in EP 0 883 160 A1.

Inner jacket 12 and outer jacket 16 may be comprised of vitreous silica (quartz), polycrystalline alumina (PCA), polycrystalline yttria, yttria alumina garnet (YAG), or other light transmitting ceramic. The preferred material transmits at least a portion of the preferred light (e.g. visible), and the unwanted or sacrificial wavelengths. The size of the outer jacket 16 is a matter of design choice. The absorbency in the outer chamber for a given particular second fill material is generally proportional to the product of the pressure of the second fill material and the path length of the light as it crosses the outer chamber. The preferred pressure is one or less atmospheres so as to help restrain the inner chamber should it fail. Practically, lower pressures lead to larger outer envelopes that may mechanically interfere with housing structures. Increasing pressure to enable a lower outer chamber size requires stronger walls, and more expensive manufacturing. Thermal flows are also affected.

There is then a design choice in balancing between the size of the outer jacket, fill pressure, thermal losses and various costs. It is also understood that it may also be desirable to tune the final spectrum by balancing the combination of the first (inner chamber) spectrum and the second (outer chamber) spectrum by controlling the absorbency.

The outer chamber 16 of the lamp is sealed hermetically and in intimate thermal contact with the inner chamber 12. Sealing of the hemispherical ends to each other as well as to the inner chamber may be accomplished by direct sealing (interference or bonding) or through the use of frit materials 24 commonly used by those skilled in the art. The outer chamber 16 may have a small tube, or orifice 26 through which the chemical fill 22 in the outer chamber 18 is introduced. The tube or hole is then sealed, for example pinched off or plugged, for example with a tapered pin of light transmissive material or sealed with sealing glass (frit).

The embodiment of FIG. 1 includes two electrodes 28 that are connected to externally extended inleads 30 that are sealed with a further frit seal 32.

With reference now to FIGS. 4, 5*a–c*, and 6*a–c*, alternative embodiments the lamp may include zero, one, or two electrodes and may take various shapes. Element numbers from FIG. 1 have been retained on corresponding elements. Zero and one-electrode embodiments may be powered by microwave (radio frequency) sources as known in the art. Note that in all embodiments, the vapor in the outer chamber 18 does not participate in sustaining the electric discharge in the inner chamber and is not in contact with the electrodes 28.

Figure 4:
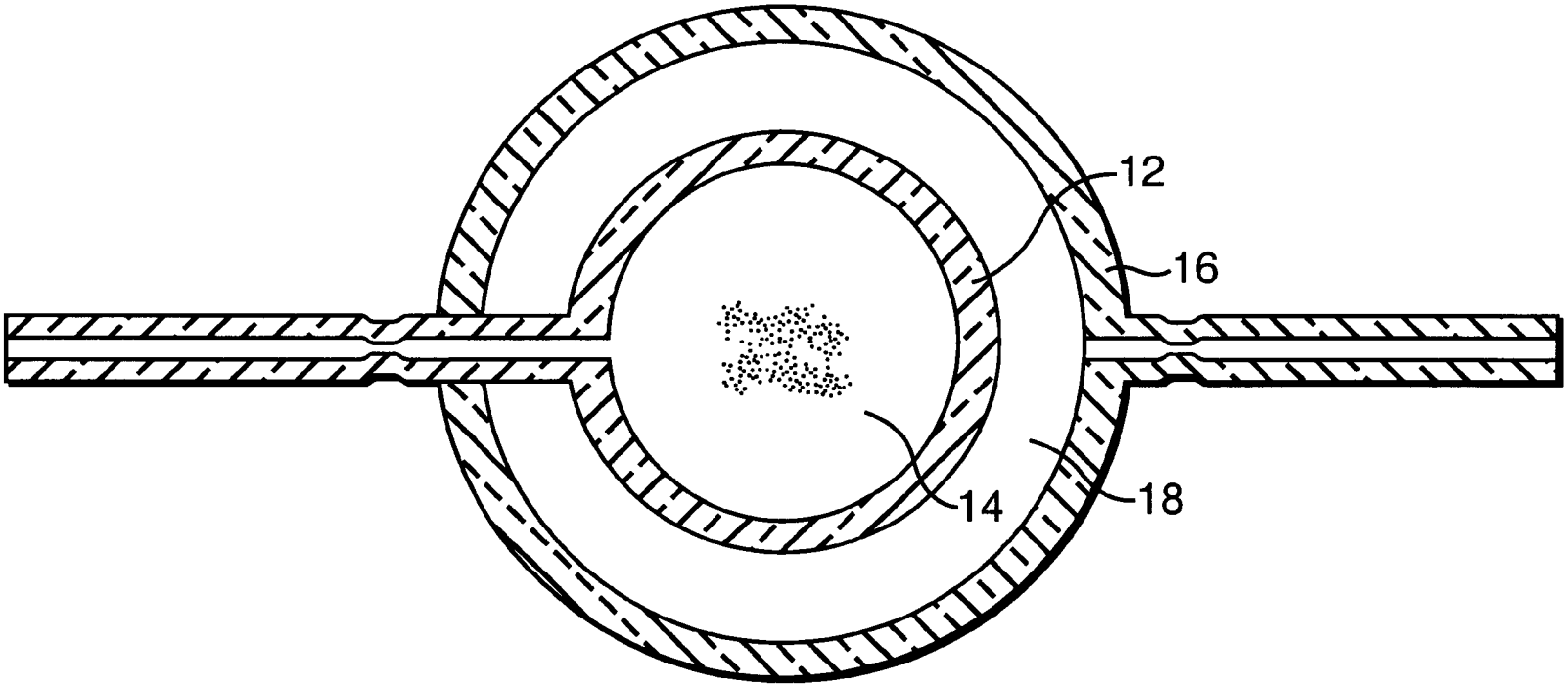
FIG. 4 is a schematic cross-sectional view of a preferred electrodeless embodiment of a double jacketed lamp.

FIG. 4 is an embodiment of an electrodeless version of a double jacketed lamp where the vessel is made from vitreous silica. The inner 12 and outer 16 jackets have independent fill tubes and can be tipped individually. Such a device can be excited with microwaves so that the inner vessel (12, 14) sustains the discharge and the outer chamber 18 merely heats as described above by adjusting the fill gas composition and pressures in the inner and outer chambers. For example, the inner chamber can contain mercury and argon gas at a cold fill pressure of 5 torr. The outer chamber may contain sulfur and nitrogen at a cold fill pressure of 400 torr. Upon exposure to a microwave field, the mercury and argon gas in the inner chamber breaks down electrically and sustains the discharge.

Figure 5C:
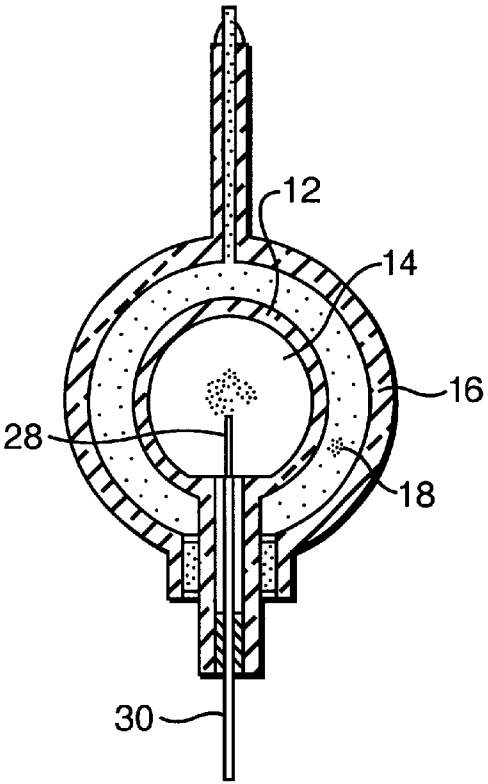
FIGS. 5*a*–5*c* show schematic cross-sectional views of single-ended embodiments of double jacketed lamps with one or two electrodes.
Figure 5B:
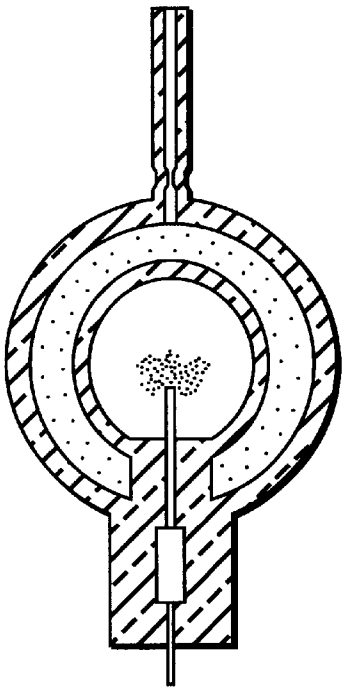
Figure 5A:
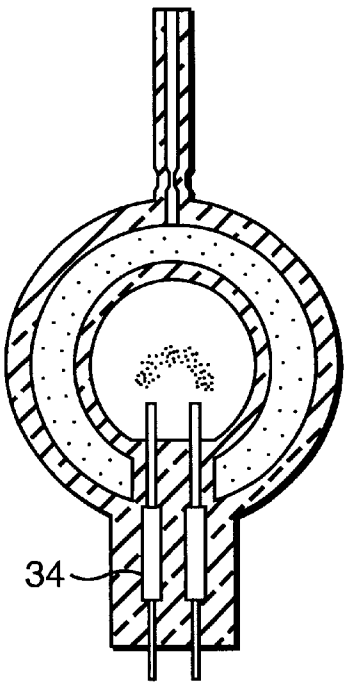

FIGS. 5*a–c* show embodiments of an electroded lamp wherein the lamp is single ended, that is, it has electrodes protruding out one end only. FIGS. 5*a–b* are two embodiments in vitreous silica (quartz) with conventional molybdenum foil seals 34. FIG. 5*c* shows an embodiment in ceramic, polycrystalline alumina, in the monoelectrode configuration. Two electroded, single ended lamps that may constitute an inner chamber are discussed in U.S. Pat. No. 6,300,716 B1, and in European Application EP 1 111 654 A1. A dual chambered quartz lamp, both single and dual ended, for the purpose of protecting the inner envelope is discussed in U.S. Pat. No. 4,949,003. The lamp envelopes need not be spherical, but may be tubular or otherwise conveniently shaped.

Similar to conventional discharge lamp operation, the inner chamber sustains an electric discharge with the application of voltage and current to the electrodes through suitable electronic control gear (ECG). This ECG can take the form of conventional magnetic or inductive ballasts, solid state switching ballasts, pulse width-modulation modulation ballasts, high frequency ballasts including microwave and RF, DC ballasts, and any of these with swept frequency operation or superimposed amplitude modulation to excite acoustic modes in the inner vessel, such as discussed in U.S. Pat. No. 4,983,889.

Figure 6C:
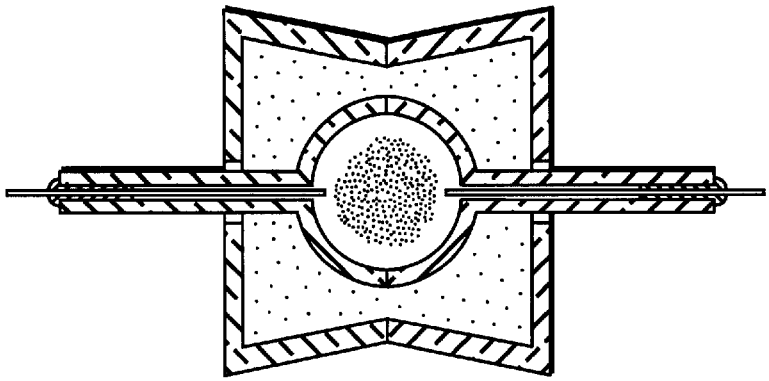
FIGS. 6*a*–6*c* show schematic cross-sectional views of alternative embodiments of double jacketed lamps.
Figure 6B:
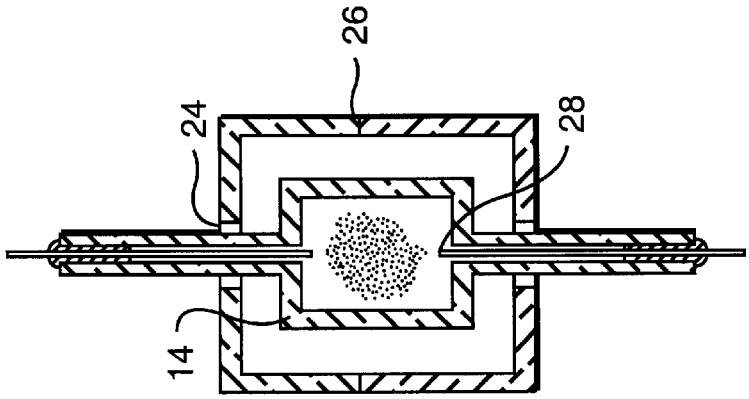
Figure 6A:
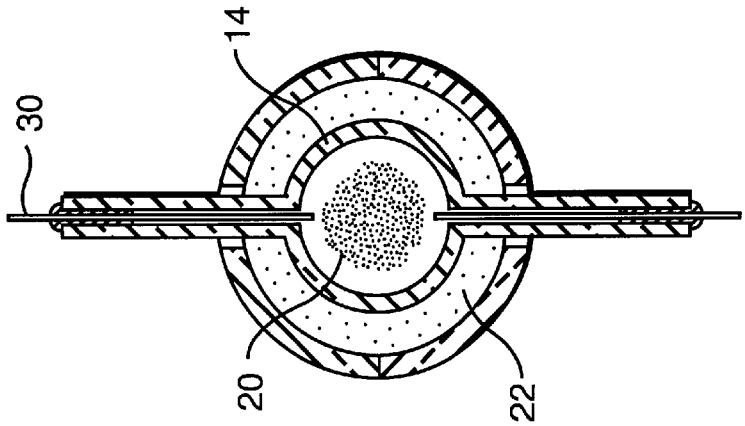

Various shapes of the lamp are depicted in FIG. 1 and FIGS. 6*a–c*. FIGS. 6*a–b* show conventional spherical and generally cylindrical shapes, while FIG. 6*c* shows an outer chamber formed from compound geometries, namely the frustums of facing cones. The latter embodiment may be suitably adjusted for independent control of absorption lengths and cold spot temperatures of the vapor in the outer chamber. Other combinations of geometries may be used to regulate path length, vapor pressure fill circulation and other features of the second (outer) fill material in the outer chamber.

The lamp may be made conventionally. For example, the embodiment of FIG. 6*a* includes an inner chamber that is an approximately spherical lamp with capillaries through which the electrode assemblies are inserted. The electrode assemblies are sealed into the capillaries with frit sealing glass. A first hemispherical section of the outer chamber is positioned onto the capillary so that the equatorial regions of the inner chamber and outer chamber are in registration. A second hemispherical section of the outer chamber is positioned over the second capillary of the inner chamber and frit is applied to the capillary joint and the equator of the outer chamber. The lamp is fired until the frit seals the equatorial region and the outer chamber and seals the second hemisphere of the outer chamber onto the capillary of the inner chamber providing the intimate thermal contact between the two chambers. Roller forming, pinch sealing, flame sealing and other forming methods known in the art may be used depending on the chosen envelope material(s). Combinations of these methods made and the sequences of steps may be altered for manufacturing convenience.

The present invention offers the additional benefit of reducing or eliminating leakage of ultraviolet light from the inner chamber into the environment. This is inherently achieved in the present invention by virtue of the vapor in the outer chamber. Prior art methods have used sleeves made of doped quartz to absorb the ultraviolet light, which turned the ultraviolet light into waste heat. The present invention recaptures some of that ultraviolet light and converts it into useful visible light.

Figure 7:
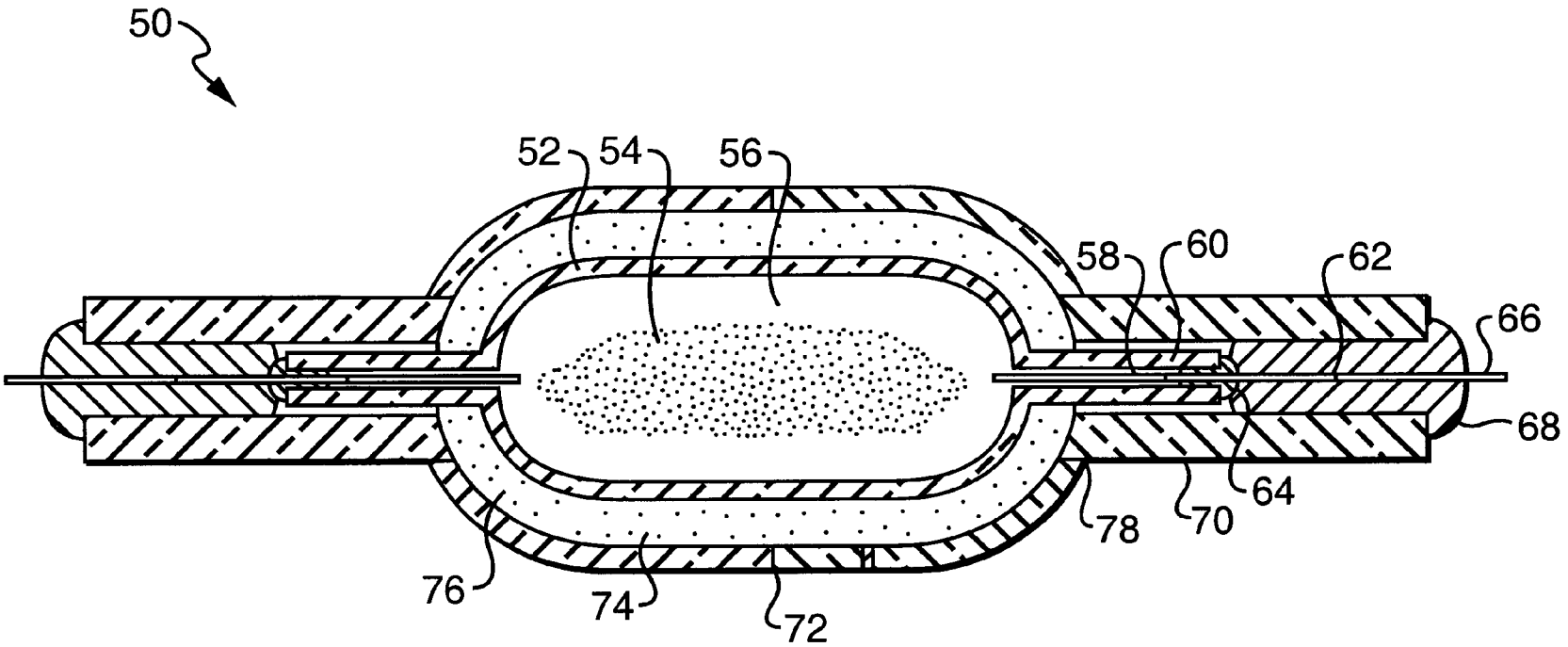
FIG. 7 is a schematic cross-sectional view of a preferred alternative embodiment of a double jacketed lamp.

With reference to FIG. 7, the present invention can also provide a ceramic lamp 50 which can operate in air and requires no further outer jacketing to protect against inner chamber failure. The lamp is assembled from an inner envelope 52 defining an inner chamber 54 enclosing a first fill material 56. Extending into the inner chamber 54 are tungsten electrodes 58. The tungsten electrodes 58 pass into inner capillaries 60 that form part of the inner envelope 52. The tungsten electrodes 58 are coupled to niobium middle leads 62 that are frit 64 sealed to the inner capillaries 60. The niobium leads 62 are in turn coupled to molybdenum outer leads 66. The molybdenum outer leads 66 are frit 68 sealed to outer capillaries 70 that form part of an outer envelope 72. The inner envelope 52 is enclosed by the outer envelope 72 to define an intermediate outer chamber 74 that includes a second fill material 76. In the preferred embodiment the outer end of the niobium middle lead 62 is covered by the outer frit 68 (contacts the inner frit 64) so there is no chemical interaction between the niobium middle leads 62 and the second fill material 76.

Intimate thermal contact is made by the electrical leads 58, 62, 66 where a weld is made between a niobium middle lead 62 used to seal the inner envelope 52 and a molybdenum lead 66 used to carry the current. Since the outer capillary seal 66, 68, 70 are far removed from the inner chamber 54 where heat is generated, the outer seal 66, 68, 70 can operate at substantially reduced temperature, for example 400° C. It is well known in the art that molybdenum inleads can withstand oxidation by ambient air if operated at such modest temperatures. Niobium internal leads are known from other ceramic lamps to operate at above 600° C. but can oxidize quickly in air causing lamp failure. By welding the niobium middle leads 62 to the molybdenum outer leads 66 and extending the seal length with the capillaries 60, 70, the outer seal 66, 68, 70 is cooled sufficiently to permit the use of molybdenum inleads 66 in air. The high temperature frit 64 used to seal the tungsten and niobium assembly to the inner capillary 60 may also be used to seal an equator seal between two halves forming the outer envelope 72, and for sealing 78 the two halves to the outer capillaries 70.

Lamp failure protection can be enhanced with the use of the outer envelope 72. To help protect against inner envelope 52 failure, the preferred second fill material 76 in the outer chamber 74 can be adjusted to have an operating pressure of approximately one atmosphere or less. In the event of a failure of the inner envelope 52, the strength of the outer envelope 72 can also be designed to contain the inner envelope pieces and the first fill 56 and second fill 76 materials. Sensing circuits in the electronic control gear can detect changes in lamp operation indicating such a failure and react to remove power from the lamp.

While embodiments of a double jacketed lamp have been described in the foregoing specification and drawings, it is to be understood that the present invention is defined by the following claims when read in light of the specification and drawings.

What is claimed is:

1. An electric discharge lamp comprising:

an envelope having a first wall of a first wall material defining an enclosed first chamber including a first fill material;

the first chamber being substantially surround by and sealed to a second wall of a second wall material defining an enclosed second chamber intermediate the first wall and the second wall, the second chamber including a second fill material;

the first fill material being excitable to light emission of a first spectrum on the application of electric power, and the first wall material being light transmissive of at least a portion of the first spectrum;

the second fill material having a gaseous state at least during lamp operation, and being excitable to light emission of a second spectrum on the application of energy from the first envelope, and being light transmissive of at least a portion of the first spectrum under operating conditions; and the second wall material being light transmissive of at least a portion of the first spectrum and of the second spectrum.

2. The lamp in claim 1, wherein the first fill material is excitable to light emission by microwave power.

3. The lamp in claim 1, wherein a first electrode extends in a sealed fashion from the exterior into the first chamber for conduction of electric power, without the first electrode contacting the second fill material.

4. The lamp in claim 3, wherein a second electrode similarly extends in a sealed fashion from the exterior into the first chamber for conduction of electric power, without the second electrode contacting the second fill material, and thereby support electric discharged between the first electrode and the second electrode in the first chamber.

5. The lamp in claim 1, where in the first spectrum includes ultraviolet light and visible light, the first wall material is transmissive of at least a portion of the ultraviolet light and the visible light; and the second fill material is excitable to visible light emission by at least a portion of transmitted ultraviolet light, and the second wall material is transmissive of at least a portion of the visible light emitted from the first chamber and of the visible light emitted from the second chamber.

6. The lamp in claim 1, where in the first spectrum includes first visible light and a second visible light, the first wall material is transmissive of at least a portion of the first visible light and the second visible light; and the second fill material is excitable to re-radiate visible light by at least a portion of transmitted first visible light, and the second wall material is transmissive of at least a portion of the second visible light emitted from the first chamber and of the re-radiated visible light emitted from the second chamber.

7. The lamp in claim 1, where in the first spectrum includes infrared light and a second visible light, the first wall material is transmissive of at least a portion of the infrared light and the second visible light; and the second fill material is excitable to re-radiate visible light by at least a portion of transmitted infrared light, and the second wall material is transmissive of at least a portion of the second visible light emitted from the first chamber and of the re-radiated infrared light emitted from the second chamber.

8. An electric discharge lamp, comprising:

a double jacketed lamp envelope with a sealed inner chamber of a first light transmissive wall material containing a first fill material that emits light when activated by electric power, and a separately sealed outer chamber between said double jackets, said outer chamber containing a second fill material having a gaseous state at least during lamp operation that converts at least a portion of the light emitted from said inner chamber that is outside the visible spectrum to at least some light in the visible spectrum, which is then emitted by the second fill material from said outer chamber.

9. The lamp of claim 8, wherein said double jacketed bulb comprises an inner light transmissive jacket that defines said sealed inner chamber and an outer light transmissive jacket around a light transmissive portion of said inner jacket that defines said separately sealed outer chamber between said inner and outer jackets, said outer jacket being in thermally transmissive contact with said inner jacket.

10. The lamp of claim 8, wherein said second fill material is vaporizable by heat from said sealed inner chamber during normal operation of the lamp.

11. The lamp of claim 8, wherein said second fill material converts at least a portion of ultraviolet and deep blue light to at least some light in the visible spectrum.

12. The lamp of claim 8, wherein said second fill material comprises sulfur.

13. The lamp of claim 8, wherein said second fill material comprises selenium.

14. The lamp of claim 8, wherein said second fill material comprises tellurium.

15. The lamp of claim 8, wherein said second fill material comprises one of carbon disulfide, boron sulfide, phosphorus, mercury halides, a mixture of xenon with one of: HCl, $AlCl_3$, sodium, or iodine vapor.

16. The lamp of claim 8, wherein said second fill material converts at least a portion of the light emitted by the first material with a wavelength less than 450 nanometers to at least some visible light with a wavelength greater than 450 nanometers.

17. The lamp of claim 8, wherein said sealed inner chamber is an electrodeless high intensity discharge lamp.

18. The lamp of claim 8, further comprising at least one electrode that extends into said sealed inner chamber.

19. An electric discharge lamp comprising:

a light transmissive inner jacket of a first wall material that defines a sealed inner chamber;

a first fill material in said inner chamber that emits light and heat when activated;

a light transmissive outer jacket around a light transmissive portion of said inner jacket and that defines a sealed outer chamber between said inner jacket and said outer jacket, said outer jacket being in thermally transmissive contact with said inner jacket; and a second fill material in said outer chamber that, when vaporized by the heat from said inner chamber when the lamp is operating, converts at least a portion of ultraviolet (UV) light emitted from said inner chamber to at least some visible light, thereby increasing an amount of visible light transmitted through said outer jacket from an amount of visible light transmitted through said inner jacket.

20. The lamp of claim 19, wherein said second fill material comprises one of sulfur, selenium, tellurium, carbon disulfide, boron sulfide, phosphorous, mercury halides, a mixture of xenon with one of: HCl, $AlCl_3$, sodium, and or iodine vapor.

21. The lamp of claim 19, wherein said second fill material converts at least a portion of light with a wavelength less than 450 nanometers to at least some visible light with a wavelength greater than 450 nanometers.

22. The lamp of claim 19, wherein said sealed inner chamber is an electrodeless high intensity discharge lamp.

23. The lamp of claim 19, further comprising at least one electrode that extends into said sealed inner chamber.

24. A method of increasing an amount of visible light from lamp that has a light transmissive inner jacket that defines a sealed inner chamber containing a first fill material that emits light when energized, the method comprising the steps of:

providing a light transmissive outer jacket around the inner jacket so as to define a sealed outer chamber between the inner jacket and the outer jacket; and providing a second fill material in the outer chamber that, when vaporized by heat from the inner chamber when the lamp is operating, converts at least a portion of ultraviolet (UV) light emitted from the inner chamber to at least some visible light, thereby increasing an amount of visible light transmitted through the outer jacket from an amount of visible light transmitted through the inner jacket.

25. The lamp in claim 19, wherein the first wall material comprises a light transmitting ceramic.

26. The lamp in claim 19, wherein the first wall material comprises vitreous silica (quartz).

27. The lamp in claim 19, wherein the first wall material comprises polycrystalline alumina (PCA).

28. The lamp in claim 19, wherein the first wall material comprises polycrystalline yttria.

29. The lamp in claim 19, wherein the first wall material comprises yttria alumina garnet (YAG).

30. The lamp in claim 1, wherein the pressure of the second fill material during normal lamp operation is one atmosphere or less.

* * * * *